US010925442B2

(12) United States Patent
Bowser

(10) Patent No.: US 10,925,442 B2
(45) Date of Patent: Feb. 23, 2021

(54) DEVICES TO AUTOMATE PROCESS FOR CLEANING SHOWERS AND BATHTUBS

(71) Applicant: Harold Bowser, Birmingham, AL (US)

(72) Inventor: Harold Bowser, Birmingham, AL (US)

( * ) Notice: Subject to any disclaimer, the term of this patent is extended or adjusted under 35 U.S.C. 154(b) by 254 days.

(21) Appl. No.: 15/507,721

(22) PCT Filed: Oct. 16, 2015

(86) PCT No.: PCT/US2015/056076
§ 371 (c)(1),
(2) Date: Feb. 28, 2017

(87) PCT Pub. No.: WO2016/061543
PCT Pub. Date: Apr. 21, 2016

(65) Prior Publication Data

US 2017/0245695 A1 Aug. 31, 2017

Related U.S. Application Data

(63) Continuation of application No. 14/515,740, filed on Oct. 16, 2014, now abandoned, and a continuation of
(Continued)

(51) Int. Cl.

| | |
|---|---|
| ***A47K 3/28*** | (2006.01) |
| ***B08B 3/02*** | (2006.01) |
| ***A47K 3/00*** | (2006.01) |
| ***E03D 9/00*** | (2006.01) |
| ***B08B 3/14*** | (2006.01) |

(52) U.S. Cl.
CPC ..... *A47K 3/281* (2013.01); *A47K 3/001* (2013.01); *B08B 3/02* (2013.01); *B08B 3/14* (2013.01); *E03D 9/002* (2013.01)

(58) Field of Classification Search
CPC ..... A47L 15/4291
See application file for complete search history.

(56) References Cited

U.S. PATENT DOCUMENTS

| | | | |
|---|---|---|---|
| 4,872,225 | A | 10/1989 | Wagner |
| 5,109,880 | A | 5/1992 | Booth |

(Continued)

FOREIGN PATENT DOCUMENTS

| | | | |
|---|---|---|---|
| CN | 1509213 | A | 6/2004 |
| CN | 101754709 | B | 5/2013 |
| CN | 103637729 | A | 3/2014 |

OTHER PUBLICATIONS

Office Action from the State Intellectual Property Office of the People's Republic of China dated May 17, 2018 from corresponding SIPO Application No. 201580055033.9, 3 pages.

(Continued)

*Primary Examiner* — Nicole Blan
(74) *Attorney, Agent, or Firm* — Law Office of Jeff Williams PLLC; J. Oliver Williams

(57) ABSTRACT

An economical and effective process for the complete removal of soap scum and dirt from surfaces such as those in showers and bathtubs without any scrubbing has been defined. This patent application defines cleaning devices that make the said process easy, practical, and automated. The said devices employ the previous referenced process and ultimately eliminates the chore of cleaning the showers and bathtubs.

13 Claims, 14 Drawing Sheets

Related U.S. Application Data application No. 14/607,156, filed on Jan. 28, 2015, now Pat. No. 9,211,569.

(56) References Cited

U.S. PATENT DOCUMENTS

| | | | | |
|---|---|---|---|---|
| 5,554,320 | A | 10/1996 | Yianakpoulos | |
| 5,624,073 | A | 4/1997 | Mueller et al. | |
| 5,820,690 | A | 10/1998 | Rolchigo et al. | |
| 5,829,459 | A * | 11/1998 | Milocco | A47L 15/4291 134/57 D |
| 5,862,545 | A | 1/1999 | Mathis et al. | |
| 6,742,199 | B2 | 6/2004 | Conway et al. | |
| 6,820,821 | B2 | 11/2004 | Linstedt et al. | |
| 7,182,090 | B2 | 2/2007 | Abbott | |
| 7,337,989 | B1 | 3/2008 | Penner et al. | |
| 2008/0271759 | A1* | 11/2008 | Burrows | A47L 15/23 134/25.2 |
| 2011/0126861 | A1 | 6/2011 | Dorigo et al. | |
| 2012/0090643 | A1* | 4/2012 | Bertsch | A47L 15/4409 134/25.2 |
| 2012/0111366 | A1* | 5/2012 | Baldwin | A47L 15/4259 134/18 |
| 2012/0145193 | A1* | 6/2012 | Buser | A47L 15/0057 134/10 |
| 2012/0182152 | A1* | 7/2012 | Hering | A47L 15/4293 340/679 |
| 2013/0152969 | A1* | 6/2013 | Seong | A47L 15/42 134/18 |
| 2013/0171023 | A1* | 7/2013 | Ben-Shmuel | A47L 15/4236 422/22 |
| 2013/0291900 | A1* | 11/2013 | Fryman | A47L 15/4225 134/25.2 |

OTHER PUBLICATIONS

International Search Report and Written Opinion in related International patent application No. PCT/US2015/056076, dated Feb. 5, 2016, 11 pages.

International Preliminary Report on Patentability in related International patent application No. PCT/US2015/056076, dated Apr. 18, 2017, 7 pages.

Office Action from U.S. Patent and Trademark Office dated Dec. 29, 2014 from corresponding U.S. Appl. No. 14/515,740.

Office Action from U.S. Patent and Trademark Office dated Mar. 30, 2015 from corresponding U.S. Appl. No. 14/515,740.

Office Action from U.S. Patent and Trademark Office dated Mar. 18, 2015 from corresponding U.S. Appl. No. 14/607,156.

Office Action from U.S. Patent and Trademark Office dated Aug. 3, 2015 from corresponding U.S. Appl. No. 14/607,156.

Office Action from U.S. Patent and Trademark Office dated Feb. 16, 2016 from corresponding U.S. Appl. No. 14/928,565.

Office Action from the State Intellectual Property Office of the People's Republic of China dated Jan. 17, 2018 from corresponding SIPO Application No. 201580055033.9, 5 pages.

* cited by examiner

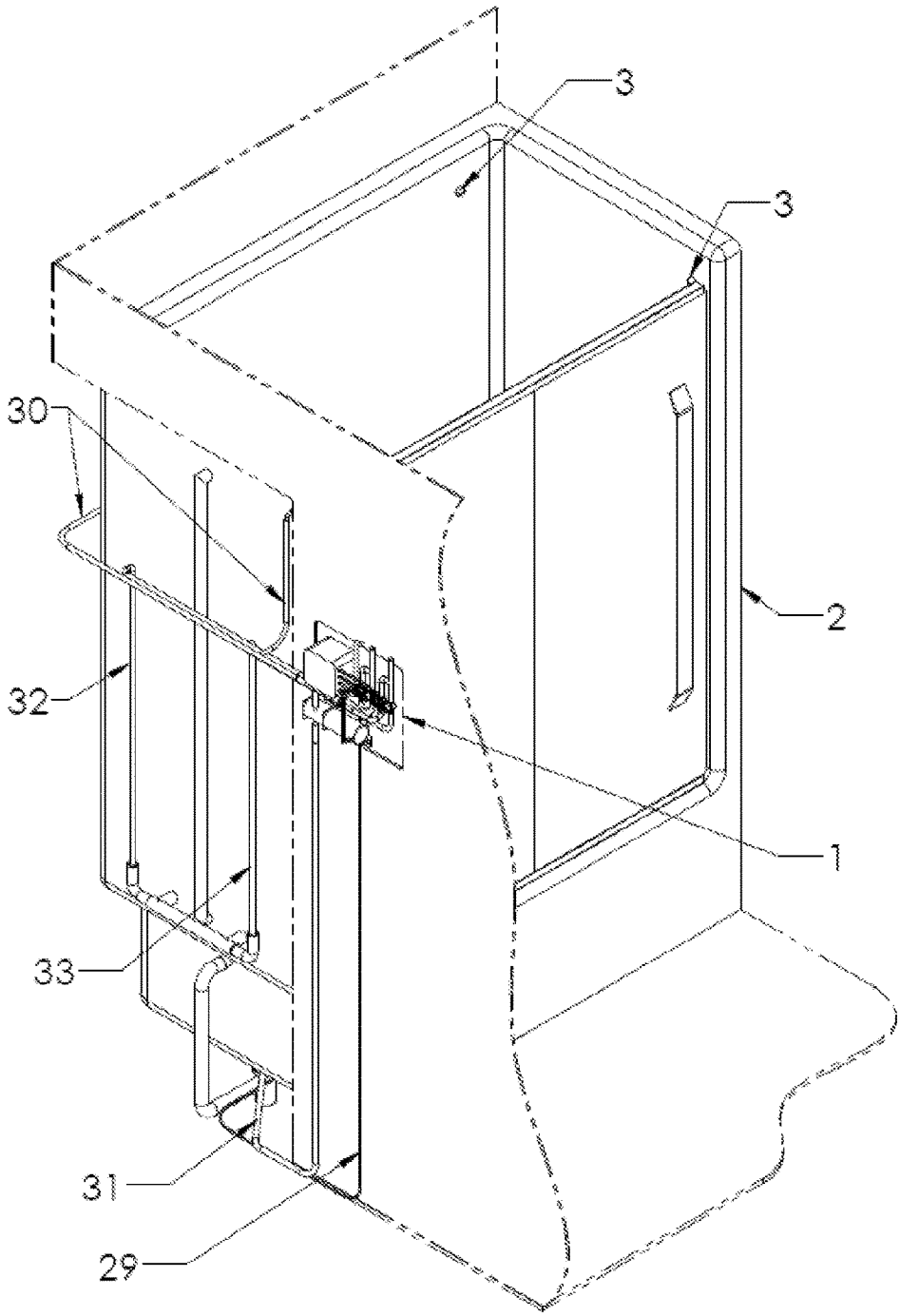
FIGURE 1: SELF-CLEANING SHOWER/BATHTUB (VIEW FROM BEHIND WALL)

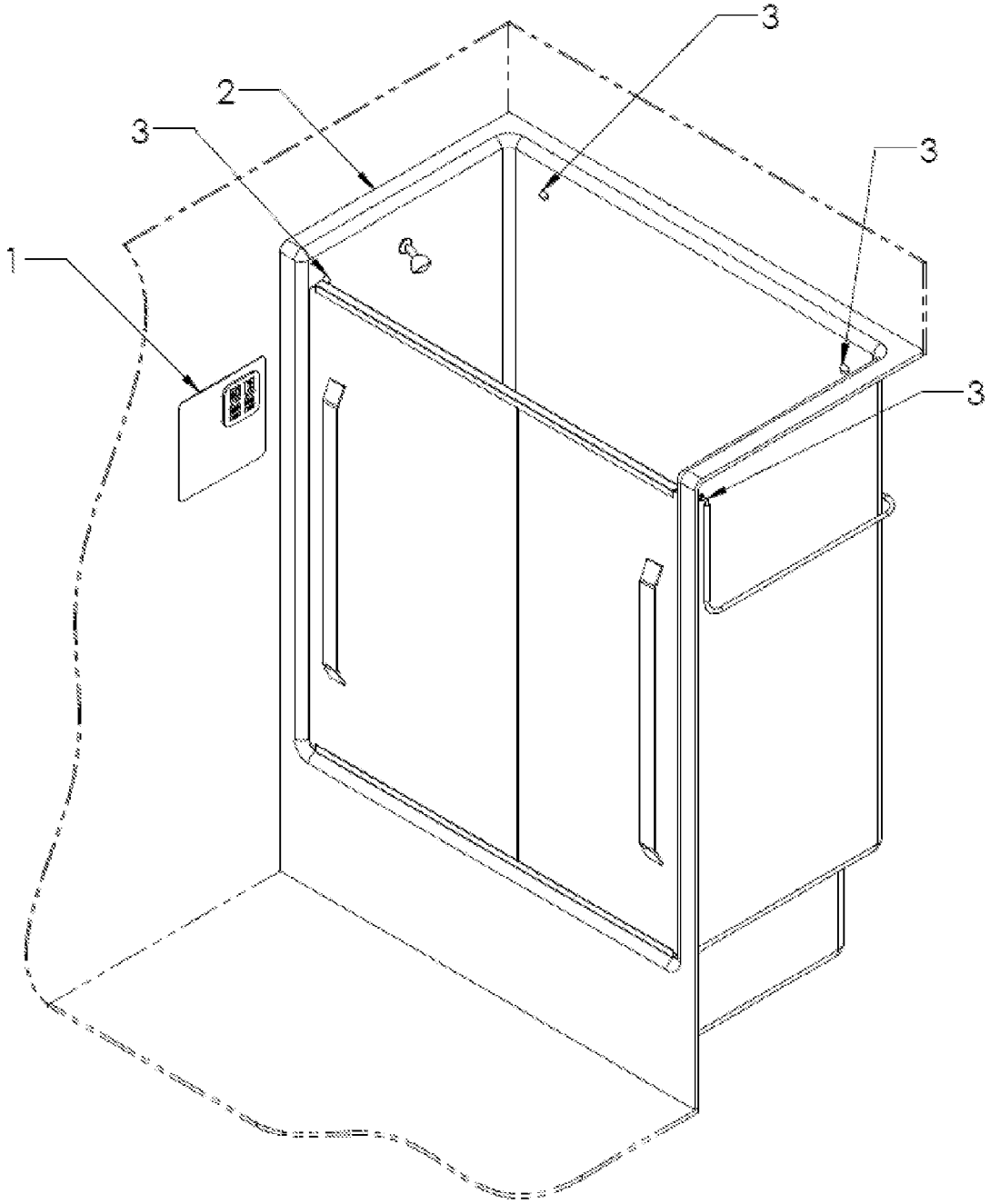
FIGURE 2: SELF-CLEANING SHOWER/BATHTUB
(VIEW FROM IN FRONT OF ENCLOSURE)

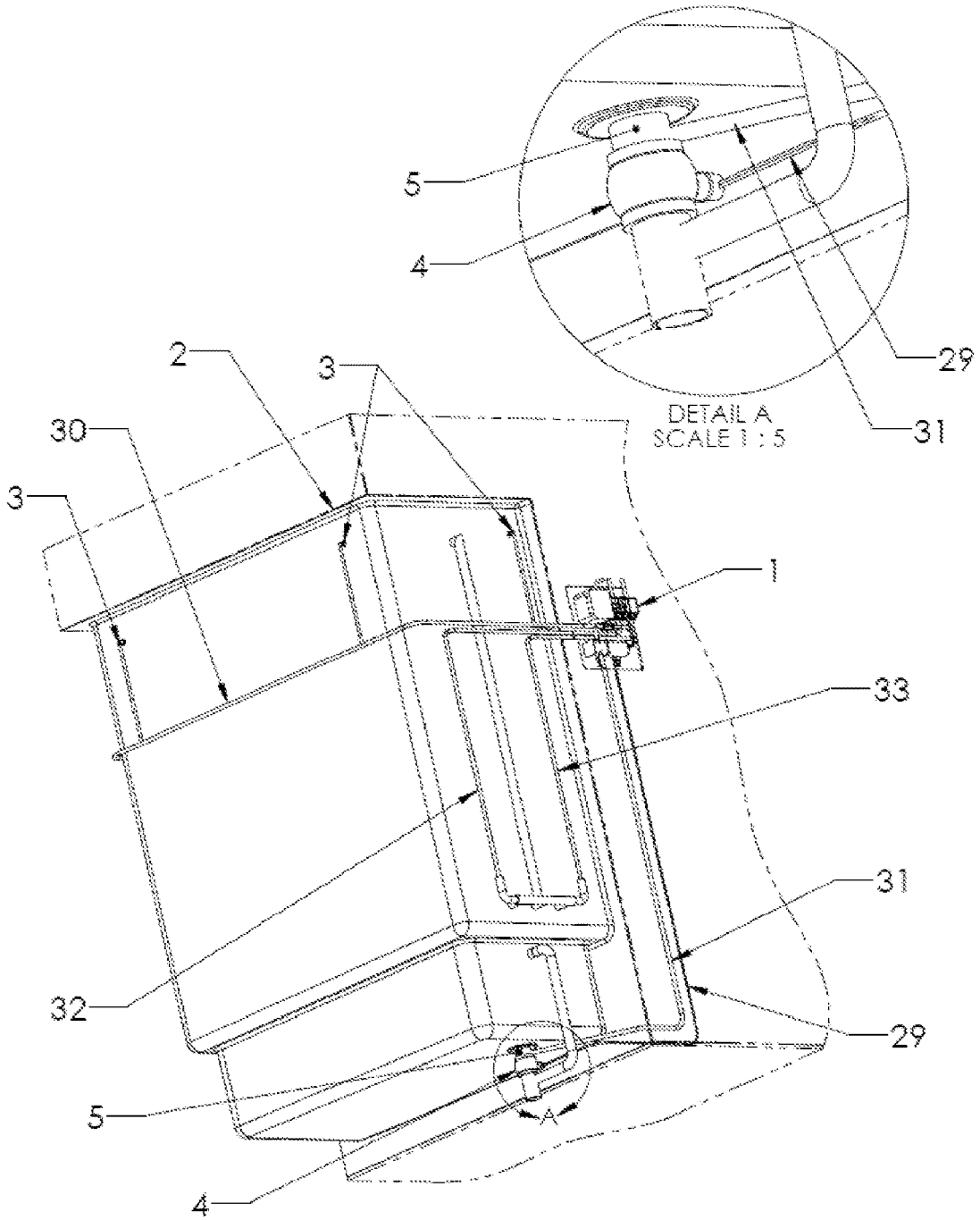
FIGURE 3: DRAIN CLOSE-OUT VALVE AND RESERVOIR

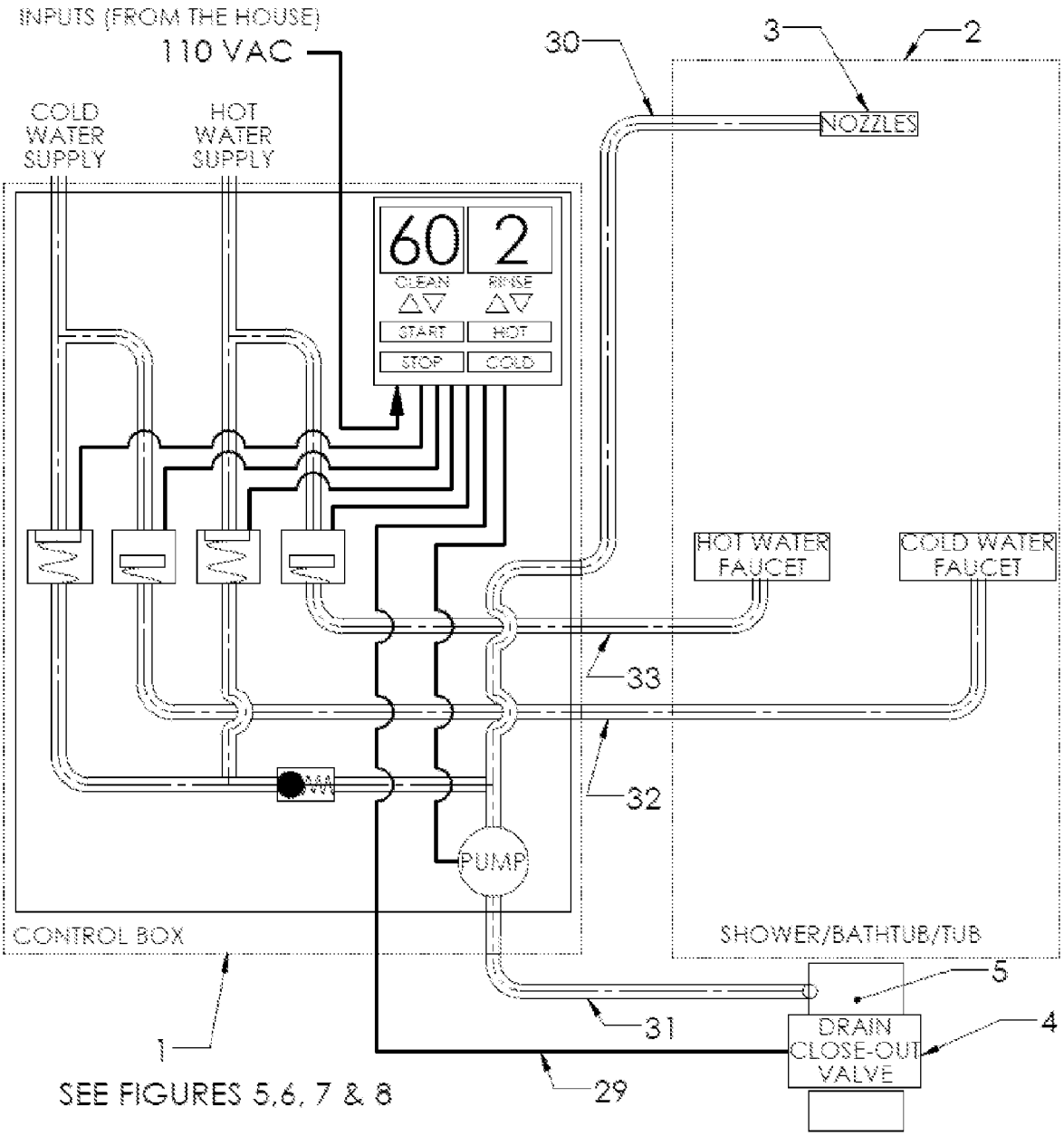
FIGURE 4: SELF-CLEANING SHOWER/BATHTUB/TUB

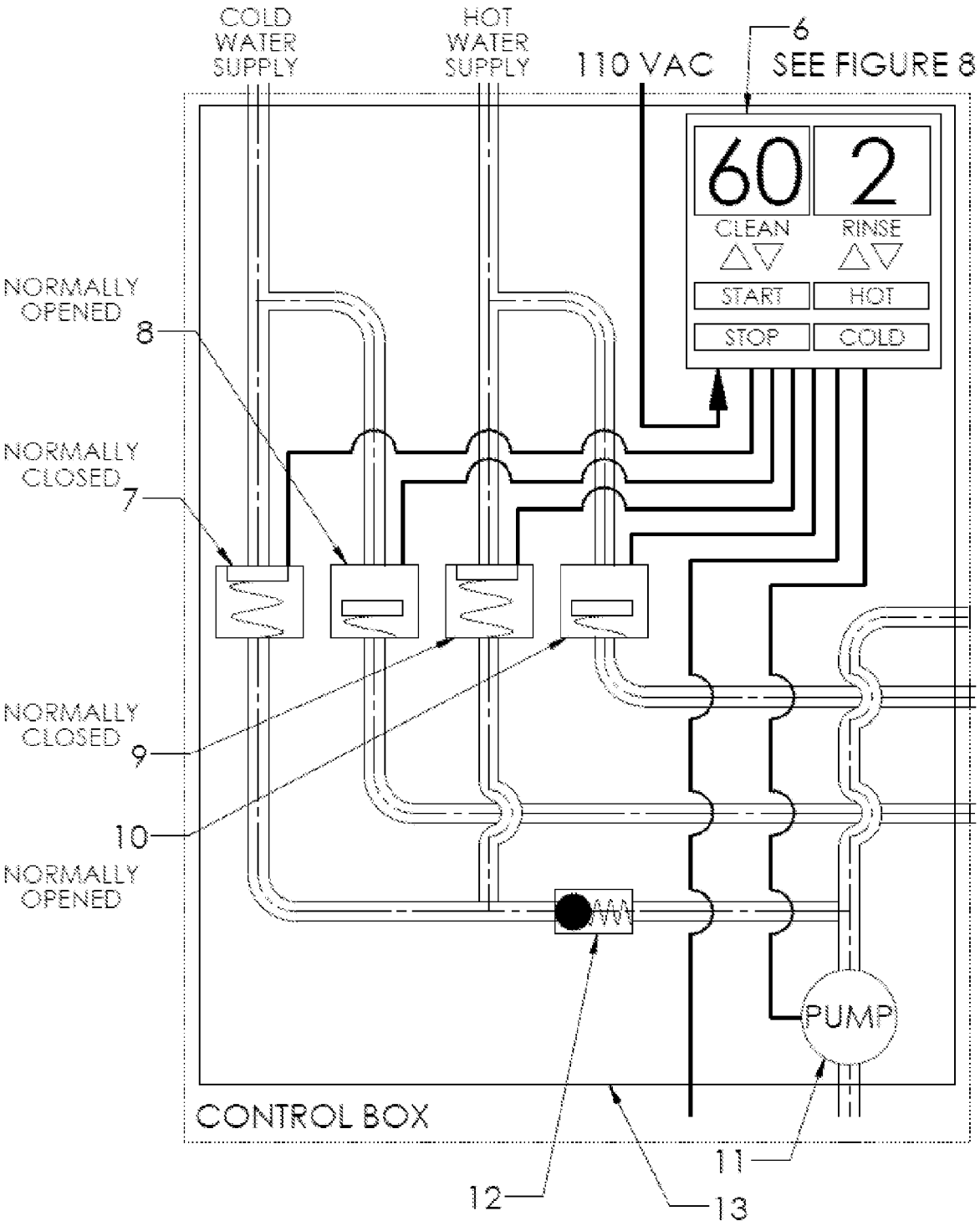
FIGURE 5: CONTROL BOX COMPONENTS

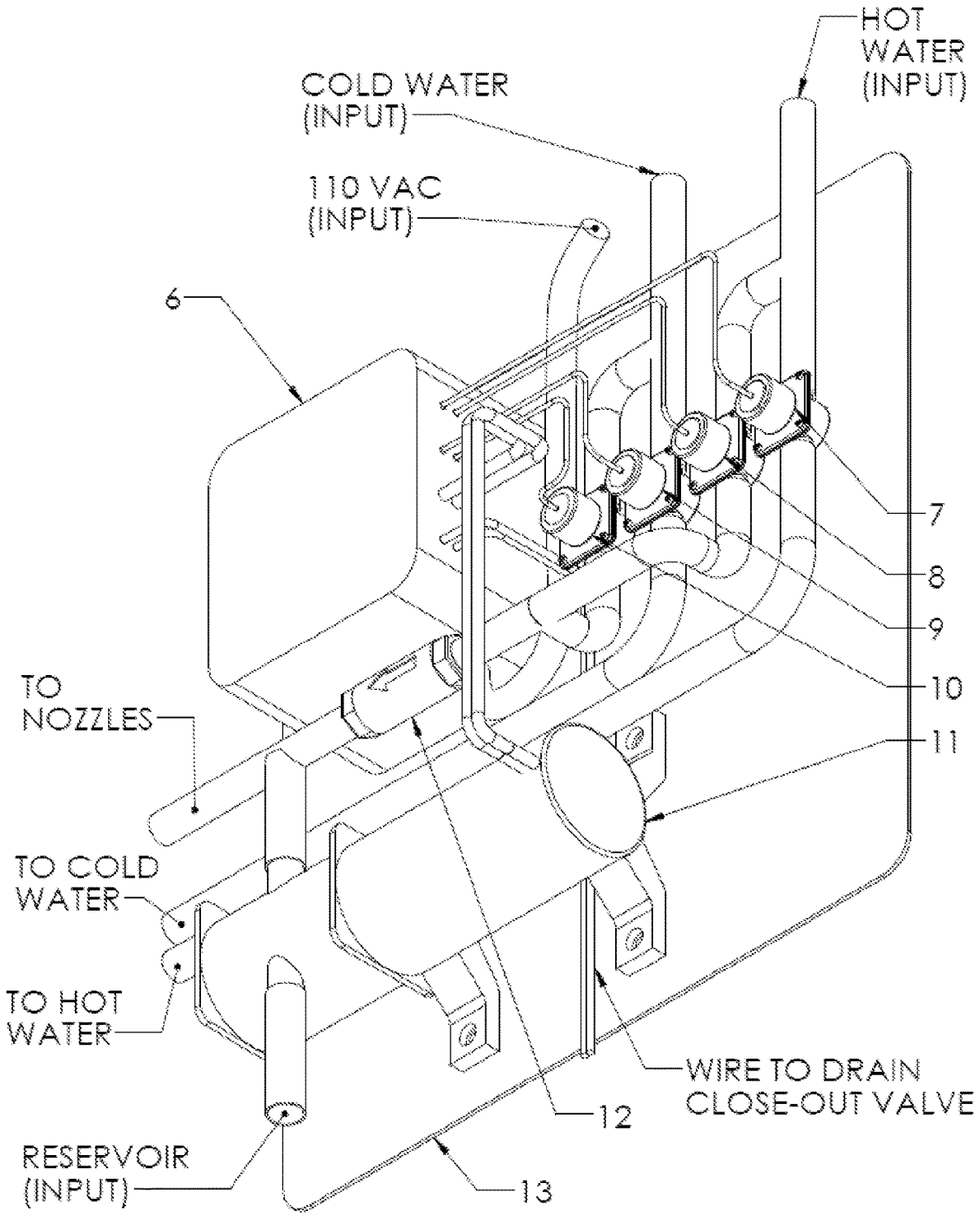
FIGURE 6: CONTROL BOX INPUTS & OUTPUTS

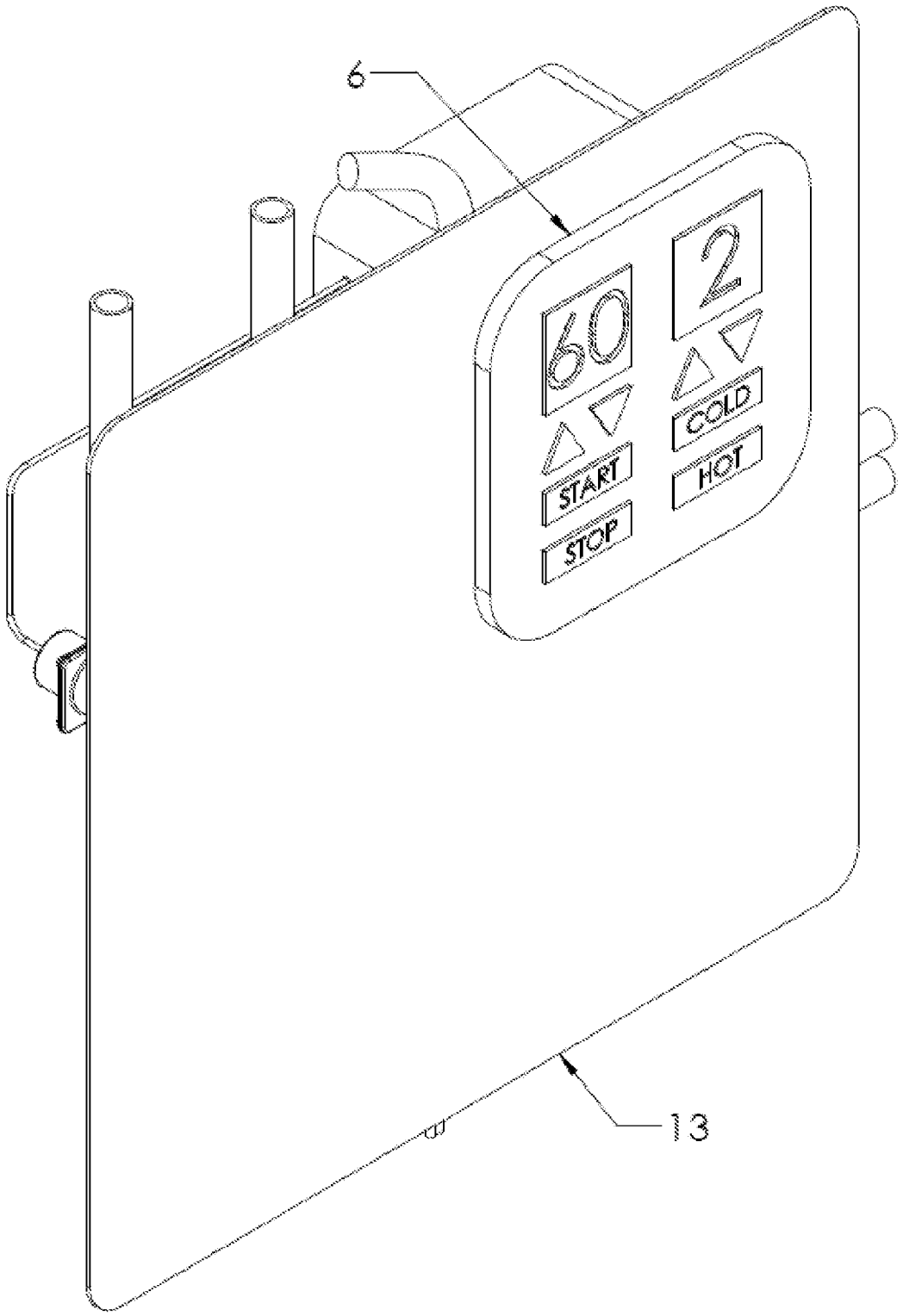
FIGURE 7: CONTROL PANEL
(USER INTERFACE)

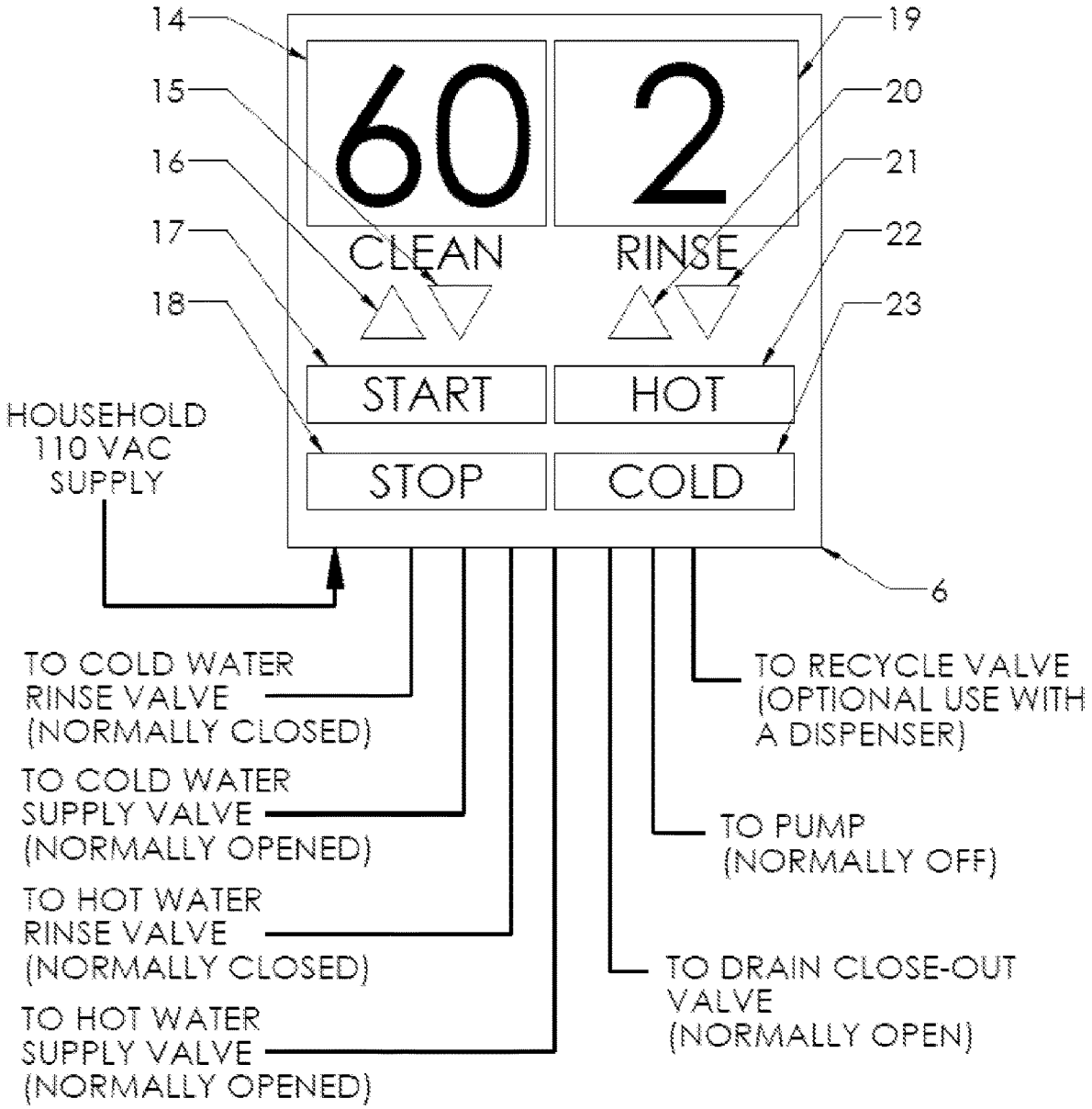
FIGURE 8: CONTROL PANEL/CIRCUIT BOARD

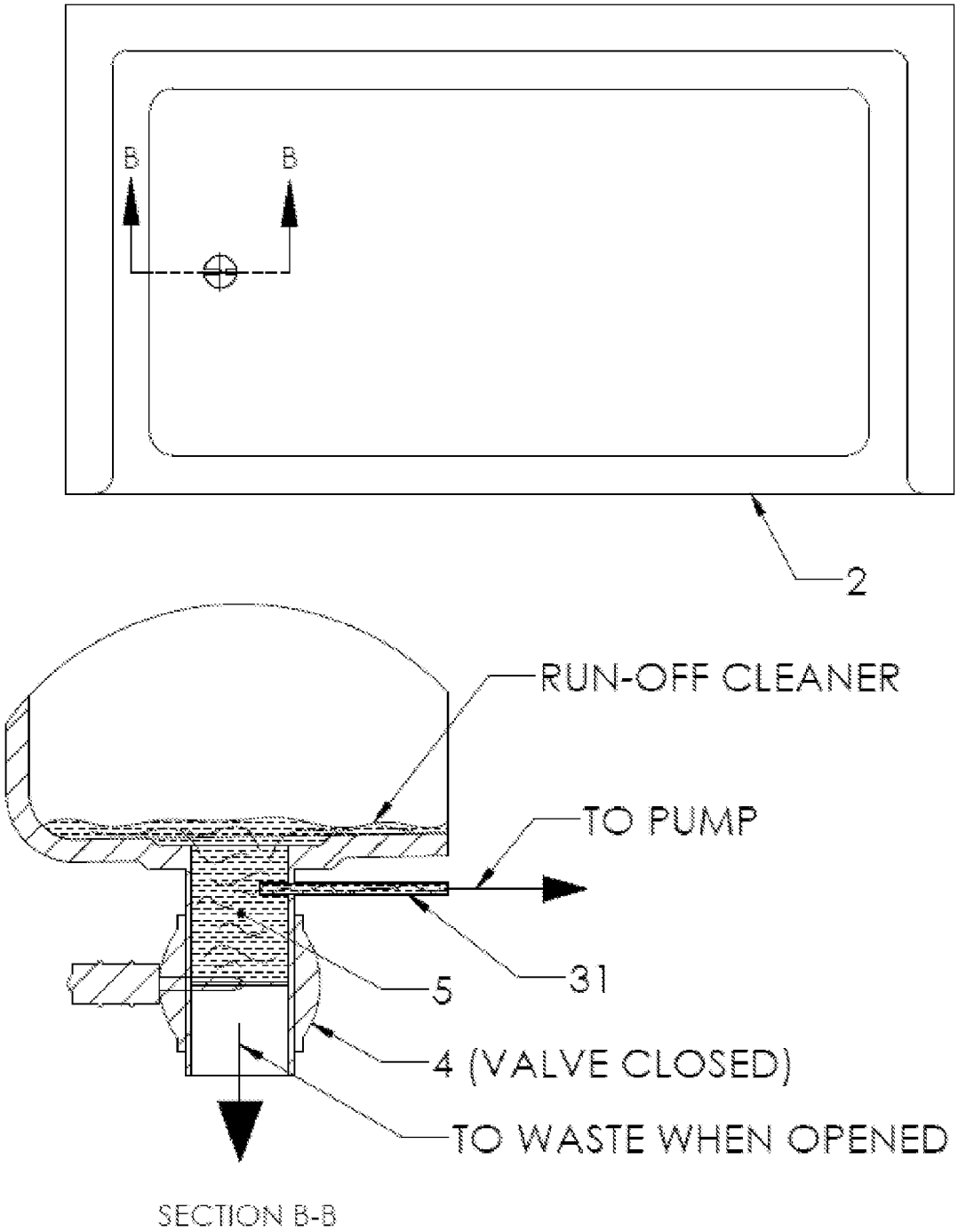
FIGURE 9: RESERVOIR

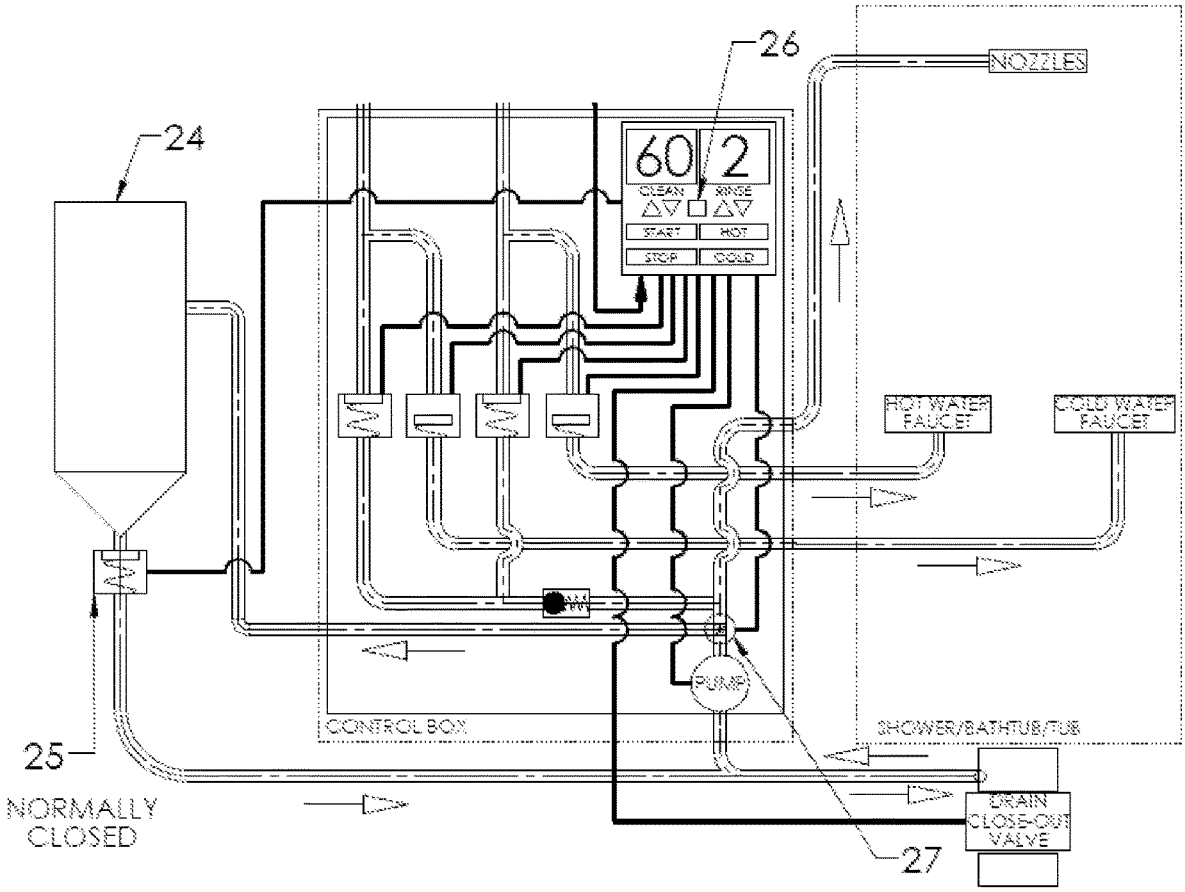
FIGURE 10: DISPENSER OPTIONS

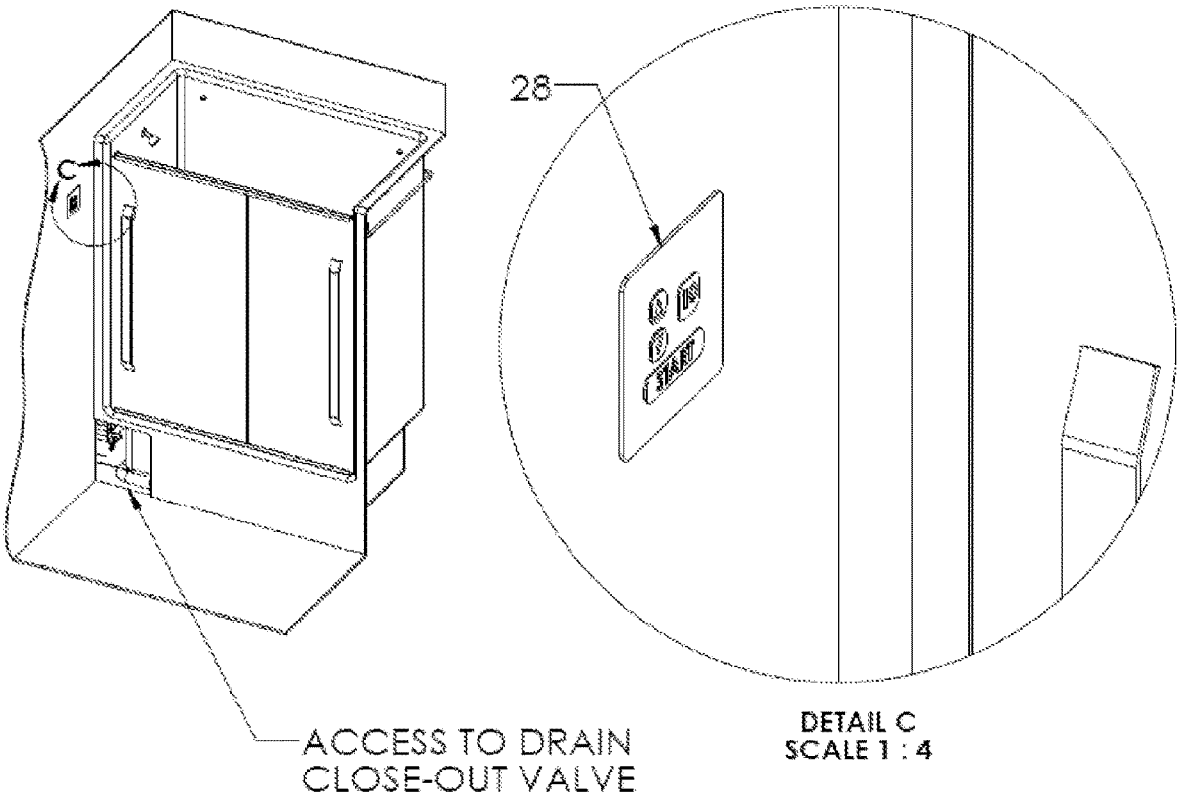
FIGURE 11: DISCREET AND SIMPILIED CONTRO BOX AND MAINTENANCE OPTIONS

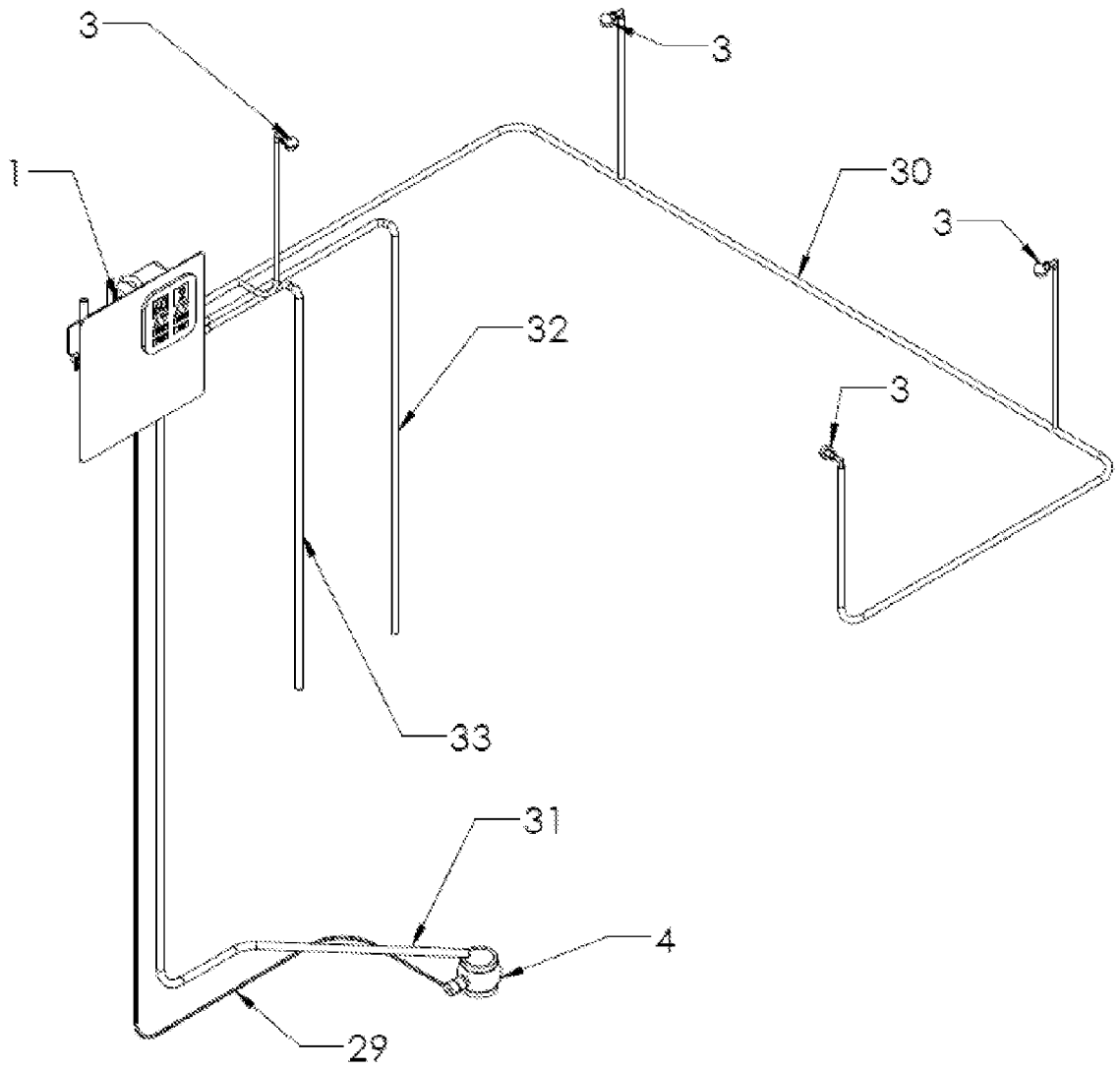
FIGURE 12: SELF-INSTALL KIT

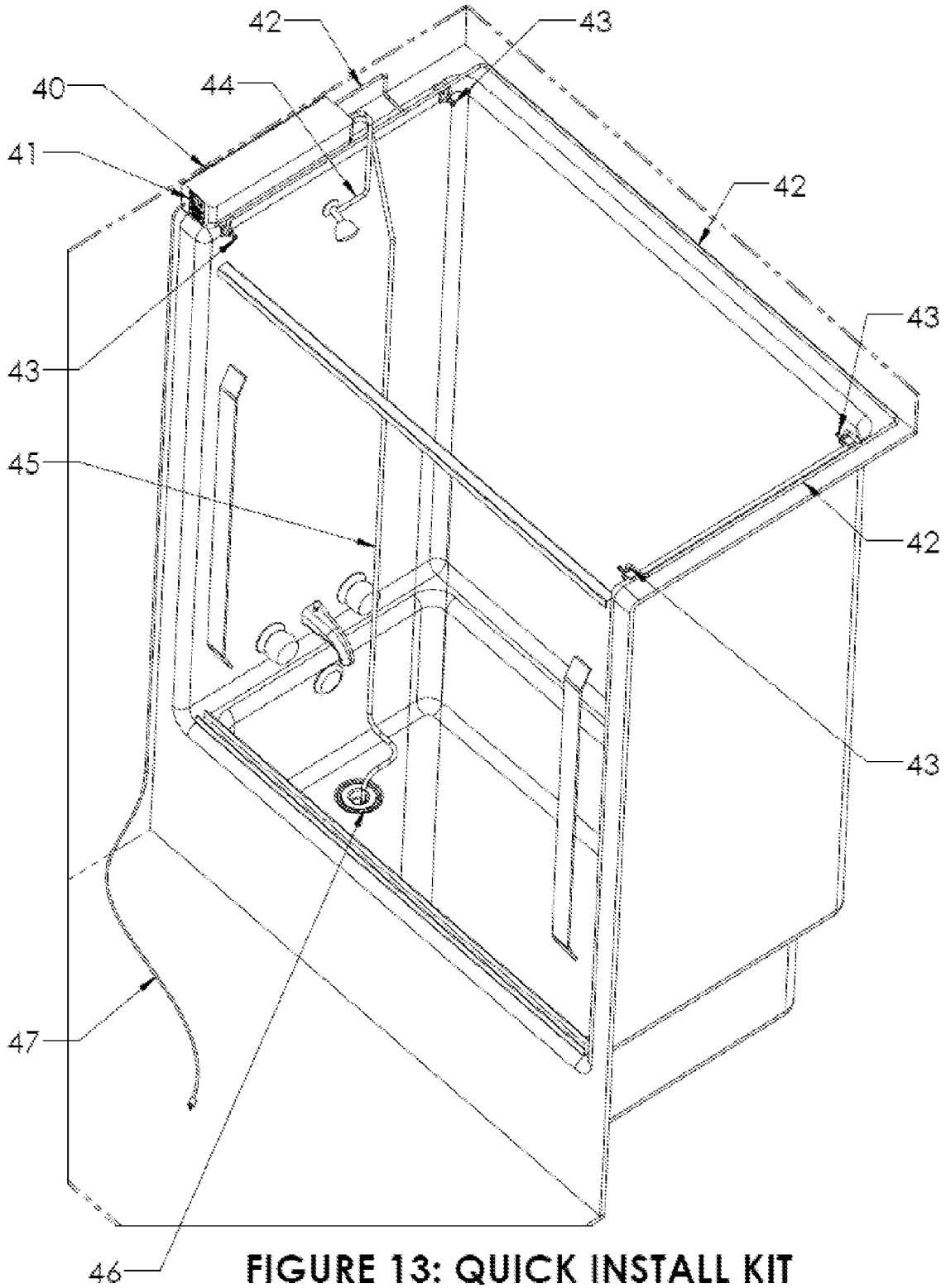
FIGURE 13: QUICK INSTALL KIT
DOORS ARE CLEAR GLASS FOR CLARITY

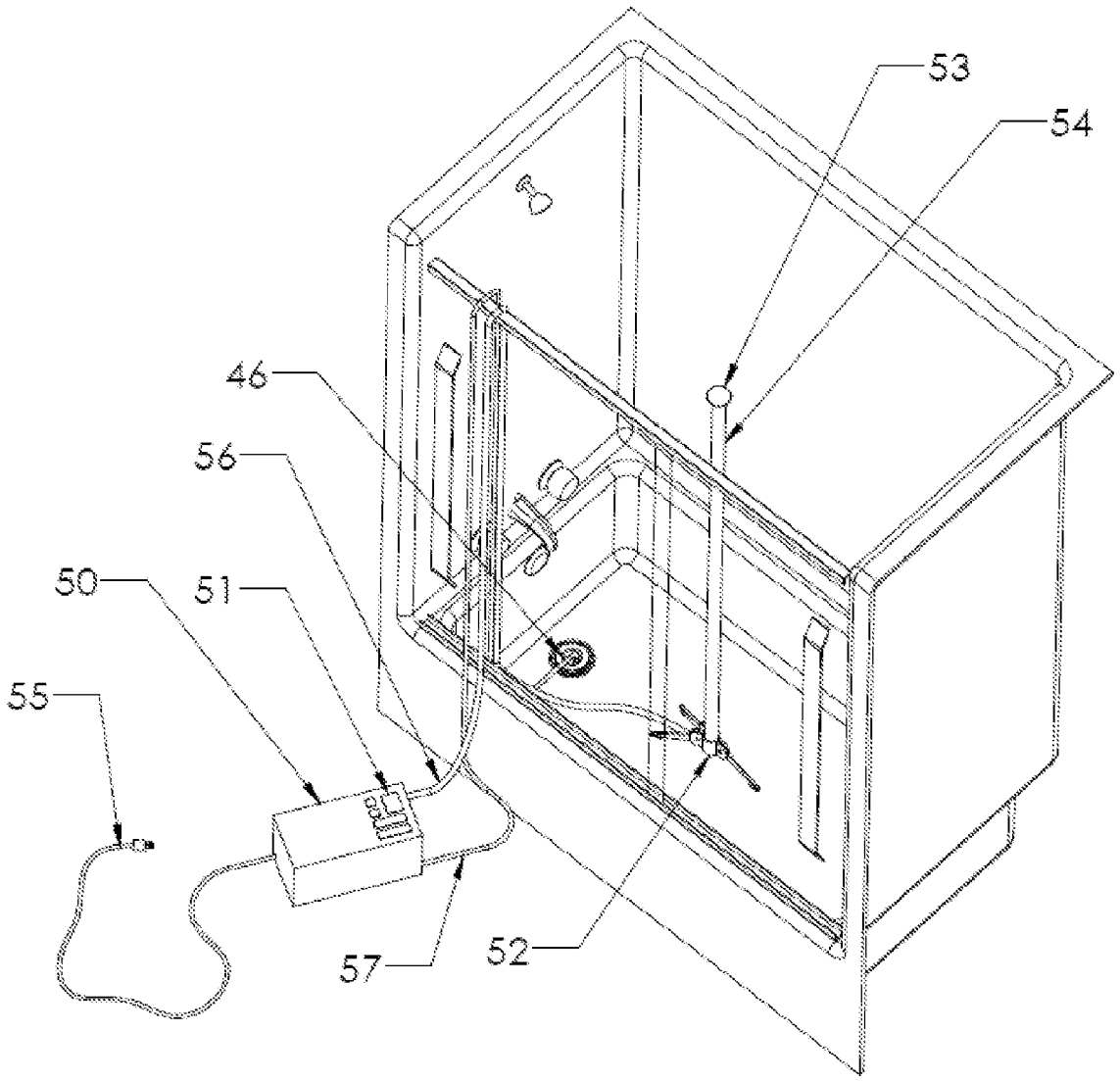
FIGURE 14: PORTABLE SELF-CLEANING SHOWER
DOORS ARE CLEAR GLASS FOR CLARITY

DEVICES TO AUTOMATE PROCESS FOR CLEANING SHOWERS AND BATHTUBS

TECHNICAL FIELD

The present application relates generally to a cleaning system, and in particular to a system following a process and method for cleaning bath enclosures.

DESCRIPTION OF THE PRIOR ART

This invention defines devices to automate the process for cleaning bathtub and shower enclosures with a continuous and sustainable spray of shower cleaning fluid. Although devices are described for the use of cleaning bathtub and shower enclosures, similar devices can be used for any cleaning task that removes soap scum.

For the purpose of this document, all bathtubs, tubs, and showers are referred to as enclosures. The enclosures include but are not limited to bathtubs, tubs, showers, and hot tubs. Most of the enclosures are rigidly enclosed with doors that are usually hinged or slide, loosely enclosed with curtains, or could have other enclosing devices. The enclosures include manufactured inserts or enclosures that are custom built in place. For the purpose of this document, an insert is one or more pieces that form the walls, floor and tubs of an enclosure. The enclosures are usually formed from composite lay-ups but are not limited to that.

Insoluble Problem

With regular use of bathtub, tub, and shower enclosures, layers of soap scum coat and build up on the walls, doors, floor, and fixtures within the enclosures. The layers of soap scum collect dirt and mildew. The enclosures could also experience calcium build-ups and rust stains.

Without this new process and these devices, the only effective means to remove the soap scum and dirt within the soap scum is to scrub the walls, doors, floors, and fixtures of the enclosure on a regular basis. If this cleaning is ignored for an extended time period, the layers of soap scum will build to be quite thick. The thicker the soap scum, the more scrubbing is required. The cleaning of the enclosures needs to be a weekly household cleaning chore that usually requires a time period that is best measured in hours depending upon the extent of the soap scum. This labor often requires the cleaner to adapt some awkward positions that makes this task even more daunting and difficult.

Prior Art

There are some commercial products available that are intended to prevent soap scum from building up while reducing the need to scrub. Most of these are intended to be sprayed in the enclosures and on the soap scum and left to dry after each usage of the enclosure. These short term and limited applications of the cleaners might be sufficient to moisten and/or loosen the scum for a moment but ineffective in washing or rinsing all the scum off the walls. Left alone, the soap scum quickly hardens again. After the short application, the soap scum remains on the walls. When dry, the scum is hardened and resists liquids.

U.S. Pat. No. 4,872,225 uses conduit and the enclosure's regular water supply to spray down the walls of the enclosure with tap water. This patent also claims the ability to add a cleaner to the water.

Although this claim has a limitless time period, water even with a diluted cleaner does not make an effective cleaning agent. This might work if there was no consideration for the amount of water spent. Considering the amount of water needed to clean a thick layer of soap scum, this is not very practical nor environmentally or economically tolerable. In addition, the device is awkward, an eye sore, and obstructive. Therefore, it has gained no commercial acceptance.

U.S. Pat. No. 6,742,199, U.S. Pat. No. 6,820,821, and U.S. Pat. No. 7,337,989 claim spray devices that utilize dispensers that store cleaners. The cleaners are sprayed on the walls and doors of the enclosures for some limited time period. These devices demand use after every use of the enclosure.

For these devices, the time period is limited by the amount of cleaner and battery life. These systems might temporarily moisten the soap scum slightly but are not adequate to soak, dissolve, and wash away the scum completely, especially if the scum has been built up.

Plus, given an ineffectively slow flow rate of just ½ gallon per minute, these systems would need 2½ gallons of cleaner for a short time period of just 5 minutes. Five minutes is not enough time to soak through layers of stubborn soap scum let alone wash it away. Even with that short cleaning cycle, 2½ gallons of cleaner at retail prices make this cost prohibited and wasteful. Removing the soap scum completely still requires regular scrubbing. There has been very little commercial acceptance for these ineffective models.

Although great strides have been made, considerable shortcomings remain.

SUMMARY OF THE INVENTION

This invention consists of a series of components that automates a sustainable, continuous, recycling spray process to saturate, dissolve, and wash away all layers of soap scum from the interior of an enclosure no matter how thick the compounded layer of scum is. The invention accomplishes this with one ordinary size of the user's favorite cleaner. The amount of cleaner will vary from 8 to 24 ounces. Most of this cleaner can also be recycled for future use making it environmentally smart.

To achieve a sustainable, continuous, recycling spray process that requires a minimum amount of cleaner, there must be a cleaner reservoir that rejuvenates or refills at the same rate that the reservoir is emptied and it must be rejuvenated with the same cleaner. This reservoir is created within the enclosure drain by placing a close-out valve in the drain pipe slightly below the upper surface of the enclosure floor. By closing the drain, the cleaner that runs off the walls runs into the drain and fills the newly created reservoir.

The basic premise of this invention is to close the drain of the enclosure. Dispense a cleaner of choice on to the floor of the enclosure where the cleaner will fill the closed-off drain. Use an electrical pump to draw the cleaner from the filled drain (reservoir) and deliver that cleaner to the spray nozzles. The spray nozzles will be designed and placed in a manner to spray that cleaner over the entire inner surface of the enclosure. The cleaning cycle will continue until all the soap scum and dirt has been loosened and washed down to the drain. After the cleaning cycle, the drain is open and the dirt is rinsed down the opened drain.

The action and sequence is controlled by a programmed digital timer that is specially pre-programmed for each configuration. Upon the 'Start' button being depressed, the digital timer closes the drain close-out valve. A delay such as 10 seconds permits the user or device to dispense the desired cleaner on the floor of the enclosure. After the short delay, the timer powers the pump. The pump is deactivated at the end of the user defined cleaning cycle.

To cover all the foreseeable, commercial demands for this type of cleaning system, there would be four different and distinct embodiments. One of the four embodiments targets the new home or building contractor. The second embodiment will address the demand from the home remodeler who wants to build into his existing enclosure the same ease and comfort as the new home owner has. The third embodiment would provide the homeowners who want at least most of the benefits without the expenditure and time required to install the fully automated embodiment. Finally, the renters will be able to use the portable embodiment and still take the cleaning embodiment with them if and when they relocate. In addition, this last embodiment can be used to clean all the enclosures desired since it is portable.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

FIG. 1 is the back of the control box as it is installed in the wall next to the enclosure for this configuration of embodiment 1;

FIG. 2 is an isometric view of the control box face and the enclosure for this configuration of embodiment 1;

FIG. 3 is a view looking up at the drain and drain close-out valve for this configuration of embodiment 1;

FIG. 3, Detail A is a close up view of the drain and drain close-out valve for this configuration of embodiment 1;

FIG. 4 is a schematic of the entire self-cleaning machine including the control box, enclosure, nozzles, drain close-out valve, and reservoir for this configuration of embodiment 1;

FIG. 5 is a schematic of the control box demonstrating the internal components, wiring, and plumbing for this configuration of embodiment 1;

FIG. 6 is a view looking up at the back of the control box with four of four inputs identified, three of three outputs identified, and one of one electrical control wire identified for this configuration of embodiment 1;

FIG. 7 is a view looking down at the face of the control box showing the control panel and user interface for this configuration of embodiment 1;

FIG. 8 is provides an overview of the user inputs for one configuration of the self-cleaning shower/bathtub/tub and a lists the electrical input to and outputs from the control panel for this configuration of embodiment 1;

FIG. 9 is the location for the sectional cut of the drain reservoir for embodiments 1 and 2;

FIG. 9, Section B-B is a sectional cut of the reservoir for embodiments 1 and 2;

FIG. 10 is a possible schematic for the use of dispenser(s) for embodiments 1 and 2;

FIG. 11 is a depiction of a discreet option where the control box is hidden within the wall and only the control panel is visible and a maintenance access panel;

FIG. 11, Detail C is a closer view of an optional control panel where the control panel is a simplified and less elaborate version for embodiments 1 and 2;

FIG. 12 is the components of the self-install kit for some of the configurations of embodiment 2;

FIG. 13 is the components of the quick install kit for the embodiment 3; and FIG. 14 is the components of the portable shower cleaner for the embodiment 4.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system and method in accordance with the present application overcomes one or more of the above-discussed problems. No prior art closes the drains of the enclosures. The device automates the said process and simplifies the cleaning of a shower or bathtub in a way that no prior art does. This device takes up no space fa the enclosure itself and can be constructed to be nearly invisible or even hidden.

The evolution of the process and devices started from a relatively unrelated event. A leaking water faucet was not repaired until it had created a rust stain on the side and bottom of a bathtub. After repairing the faucet, attempts to remove the rust stain failed. After seeing a commercial for a calcium, lime, and rust cleaner, the cleaner was used. After unsuccessfully trying to remove the rust stain from the side of the tub, it was noted that the rust stain was removed where the cleaner had pooled and soaked the bottom of the tub. Soaking the rust stain in the cleaner was the answer.

Several attempts to hold the cleaner against the side of the tub failed. The task was then to figure out a means to soak the side of the tub without removing the tub and lying it on its side. This question created the first concept.

The solution was to soak a paper towel with the cleaner and stick it to the side of the tub over the rust stain. (A light piece of paper sticks to anything when it's wet.) The cleaner removed the rust stain as though the rust stain was on the bottom of the tub soaking in the cleaner. In other words, this process worked for removing a rust stain on the vertical wall of the tub.

With the joy of having removed the rust stain, it was also noted that the soap scum, in the form of a bathtub ring, immediately above the rust stain, where the paper towel incidentally overlaid the bathtub ring, was also removed without any scrubbing. That created yet another question in an inquisitive mind. Could the cleaner soaked towels be used to clean thick soap scum off a shower wall? This question led to an intermediate process.

After soaking several disposable cloths in the cleaner and spending several hours hanging the soaked disposable cloths on all the shower walls that had very, very thick soap scum on them, it was determined that soaking the soap scum for a longer period of time would remove the scum without any scrubbing—no matter how thick the scum was. This intermediate process also removed rust stains and calcium deposits. It was a surprising success and discovery.

But the final process was not yet obvious. The problem still remained that hanging the soaked cloths was also a time consuming and dreadful task. The only way this process would be useful is in the rare occasion that the soap scum was so thick that it would take hours to clean the shower. The next step was to find a simpler process to soak the vertical walls of a shower with shower cleaner for prolong periods of time.

During this experimentation and testing, the bottom of the shower was never covered with soaked clothes but came clean simply because the cleaner ran off the soaked cloths and pooled on the floor of the shower. This observation formed the next set of questions. How could the run-off cleaner be recycled and sprayed onto the walls again? The second part of this question was; would the recycled cleaner be effective?

It was also noted that the pooling cleaner on the shower floor was too shallow to siphon off the floor and spray it back on the walls. It was also realized that the run-off ran down the drain too quickly to reuse it thoroughly. With some deep thinking, the solution evolved over a period of time. The concept for a revolutionary, new process was born.

The idea of closing the drain, allowing the run-off cleaner to pool in the drain, siphoning the cleaner from the drain, and re-spraying it back on the walls in a continuous cycle seemed plausible. But there were still some questions. The biggest and most direct questions were, "How to do that practically?" and "Will it work?"

To answer the questions and make the process practical, a crude model similar to the fourth embodiment of this patent was built. That crude model was used to test the concept. The testing proved to be effective. The results were unusually and surprisingly positive.

As the original device (cleaning device) developed, the automation grew to the point where cleaning the shower is as simple as pressing one button. In Addition, four different and distinct uses and users were identified during the design and development of the cleaning device. The four embodiments in this patent have been designed to serve all four users.

The prior art demonstrates that the need for a simpler means to clean showers and bathtubs is a long-felt need. One of the cited references goes back a quarter of a century. The lack of commercial acceptance of the prior art demonstrates the failure to solve the problem.

This automated process will relieve hundreds of millions of homeowners, renters, and cleaning professionals from the daunting and tedious task of cleaning showers, bathtubs, and tubs. It is highly likely that the members of the USPTO are a few of these homeowners and renters. The availability of the automated process will enhance the majority of the public's lives by virtually eliminating a household chore which has been a long-felt, unresolved need.

Through observations, research, and testing, a sustainable and continuous spray process to soak, dissolve, and wash away soap scum has been found to be effective in cleaning showers and bathtubs. Since this process recycles the run-off commercially available cleaners, the process is also economically practical and environmentally friendly. It also solves a long-felt, wide spread, need.

As with any process, tools and equipment are needed to make the process possible and sometimes even practical. A device has been designed and built to test and prove that the above process is effective. Using innovative thinking, four embodiments of this device have been designed to serve four different public groups. The most elaborate device developed to date, provides the most automation where the most basic will serve the fourth group.

With the production of this device, new homes across the country will have self-cleaning showers and tubs. As the number of self-cleaning showers and tubs grow, manufacturers of cleaners will find improved cleaners to make this process even more effective. The design of the said devices will evolve to better meet the public's demands and needs. In the future, scrubbing a shower or bathtub will be like using a broom to sweep your carpets today.

The process and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Within, there are four devices defined. What the four different devices (embodiments) have in common is that each closes the enclosure drain to create a reservoir for and prevent the premature loss of the run-off cleaner, uses a pump to siphon the run-off cleaner out of the created reservoir, and delivers the run-off cleaner to spray nozzles as needed to create the spray. This spray soaks, dissolves, and washes away the scum as specified in the previous process.

Utilizing the said process, the device is capable of maintaining this cycle for the time period set by the user. The devices automate an otherwise tedious process. The more elaborate devices can be operated with a push of one button. The cleaning can be done after each shower or can be a weekly event that requires only a push of a button. The longer between cleanings, the greater the cleaning cycle time should be.

Referring now to the drawings wherein like reference characters identify corresponding or similar elements in form and function throughout the several views.

REFERENCE NUMERALS IN DRAWINGS

Control Box (embodiments 1 and 2)
2 Enclosure (might be customer supplied)
3 Nozzle (might be customer supplied)
4 Drain Close-out Valve (embodiments 1 and 2)
5 Reservoir (not an actual physical component but an integral part to explain the invention)
6 Control Panel (similar for all embodiments)
7 Cold Water Rinse Valve (option for embodiments 1 and 2)
8 Cold Water Shut-off Valve (option for embodiments 1 and 2)
9 Hot Water Rinse Valve (option for embodiments 1 and 2)
10 Hot Water Shut-off Valve (option for embodiments 1 and 2)
11 Pump (all embodiments)
12 Check Valve (option for embodiments 1 and 2)
13 Control Box Mount
14 Cleaning Cycle Time Display
15 Decrease Cleaning Cycle Time Button
16 Increase Cleaning Cycle Time Button
17 'Start' Button
18 'Stop' or 'Cancel' Button.
19 Rinse Cycle Time Display (option for embodiments 1 and 2)
20 Increase Rinse Cycle Time Button (option for embodiments 1 and 2)
21 Decrease Rinse Cycle Time Button (option for embodiments 1 and 2)
22 Hot Rinse Cycle (option for embodiments 1 and 2)
23 Cold Rinse Cycle (option for embodiments 1 and 2)
24 Dispenser (option for embodiments 1 and 2)
25 Dispenser Control Valve (option for embodiments 1 and 2)
26 Cleaner Recycle Button (option for embodiments 1 and 2)
27 Cleaner Recycle Valve (option for embodiments 1 and 2)
28 Discreet Control Box (option for embodiments 1 and 2)
30 Nozzle Tubing (embod. 1 & 2)
31 Cleaner Supply Tube (embod. 1 & 2)
32 Cold Water Supply Line (option for embodiments 1 and 2)
33 Hot Water Supply Line (option for embodiments 1 and 2)
34 Drain Close-out Control Wire (embodiments 1 and 2)
40 Control Box (embodiment 3)
41 Control Panel (embodiment 3)
42 Nozzle Tubing (embodiment 3)
43 Nozzle (embodiment 3)
44 Water Supply Line (embodiment 3)
45 Cleaner Supply Tube (embodiment 3)
46 Drain Plug (embodiment 3 and 4)
47 Power Cord (embodiment 3)
50 Control Box (embodiment 4)
51 Control Panel (embodiment 4)
52 Base (embodiment 4)
53 360° Spray Nozzle (embodiment 4)
54 Telescoping Support (embodiment 4)
55 Power Cord (embodiment 4)
56 Nozzle Supply Tubing (embodiment 4)
57 Cleaner Supply Tube (embodiment 4)

This invention defines a process to remove soap scum. This invention also includes the definition of four devices that automates the said process.

The process is to use a commercially available cleaner to spray the entire scum covered surfaces; gather the run-off cleaner, use the run-off cleaner to continue the spraying of the surfaces, and continue the process by repeating the two previous steps until the scum is removed. If a shorter cleaning cycle is desired, stop the cycle after the scum is completely soaked, wipe the remaining, soaked soap scum off the interior surfaces (no scrubbing required). The only foreseeable reason that soap scum would remain is that the process was not long enough to soak and soften the deepest layers of scum. In this case, repeat the entire process if required until all scum is removed or is able to be wiped off.

The sustainable, continuous, spray is achieved by creating a reservoir 5 of cleaner that is continuously refilled by the cleaner that runs off the interior of the enclosure 2 and down to the drain. By closing the enclosure 2 drain, the run-off cleaner continuously pools at the drain. A pump 11 uses the cleaner supply tube 31 to siphon the pooling cleaner from a position that is slightly above the drain close-out valve 4. The pump 11 moves and pressurizes the cleaner to the spray nozzles 3. A set of nozzles 3 is required to direct the flow of cleaner in a manner to cover all the interior surfaces of the enclosure 2. Once the cleaner is sprayed onto the interior surfaces of the enclosure 2, the cleaner moistens the scum and runs back down to the reservoir 5 where it will be reused and recycled. This action continues for the period of time set by the user. Because the cleaner is continuously recycled, the amount of the user preferred cleaner required is kept to a minimum.

The first of four embodiments is a fully automated self-cleaning shower, bathtub, or tub enclosure. One of the more elaborate configurations is defined here. A few of the options that are not found in the lesser elaborate configurations are identified. It is essential to note that the large number of possibilities and options prohibit the description of all of them to be described here. The options will be determined by the commercial demand.

This embodiment as seen in FIG. 1 and FIG. 2 has five main components. These five main components are the control box 1, enclosure 2, nozzles 3, drain close-out valve 4, and reservoir 5. The reservoir 5 is not an actual physical component but instead is created when the drain close-out valve 4 is closed. Identifying the reservoir 5 makes the explanation of the invention easier to understand and the reservoir 5 is essential to this invention. These five components are' common to all four embodiments in some form.

The control box 1 acts as the housing for the components that control the actions and sequence of the cleaning device. Although this configuration depicts that the major components mounted in the control box, it is not necessary to mount all the components together. The mounting or installation of all the components in one location should make for ease of maintenance. But a large, visible control box might not be acceptable to the surrounding decor. In these cases, the components could be installed in a closet or under a cabinet making visible only that which is acceptable to the owner. One more of the many possible configurations is to have all the components encompassed within the shower or bathtub enclosure. This configuration creates the greatest ease of installation.

The enclosure 2 is any stall or area for cleaning or bathing, typically referred to as a shower, bathtub, or tub. Existing commercially available inserts can be used but could be modified to better fit this purpose. The current shower inserts do not have a provision to prevent overflow as the bathtubs do. The user of these inserts might want to modify each insert to provide an overflow in the event that the drain close-out valve 4 does not open as intended. The location and number of nozzles 3 have to be decided by the installer. Once that decision is made, the inserts require the proper modifications for the nozzles 3 to be installed. Those modifications are dependent on the design of the nozzles 3 and could be as little as a drilled hole for each nozzle 3.

Where the enclosure 2 is an insert and supplied as part of the self-cleaning shower or bathtub, the insert will be specifically designed with the nozzles 3 located, designed, and installed within the insert. Testing and redesign will maximize the effectiveness of the spray pattern from the nozzles 3 to cover the entire interior surface of the enclosure. In addition, research and development will be used to identify the best surfaces and finishes to enhance the cleaning device even more. A specifically designed self-cleaning insert will place the drain in a location that will permit the drain close-out valve 4 to be replaced without the removal of the insert. FIG. 11 shows an access cut-out that would help facilitate the replacement of the drain close-out valve 4.

The nozzles 3 are to convert the pressurized cleaner into a spray and direct the spray in a pattern to cover all of the interior surfaces of the enclosure 2. The design of the nozzles 3 will vary greatly. More elaborate nozzles 3 would be oscillating nozzles 3. Many modern day custom homes have the enclosures 2 custom built into their bathrooms. The decor for each enclosure 2 varies far too much and must be addressed individually in some installations. The nozzles 3 might be custom made and fabricated to match the decor. The nozzles 3 will be required to have varying colors, finishes, and platings. The owner might wish to have the nozzles 3 concealed to the greatest degree possible. Furthermore, these nozzles 3 can be embedded into different features such as the curtain rod, the upper rail for sliding doors, or even figurines. In some cases, the supplier of the cleaning device could offer adjustable nozzles of differing sizes, shapes, styles, materials, finishes, and colors. In other cases, this invention might not include the enclosure 2 and/or nozzles 3.

FIG. 3, Detail A shows the drain close-out valve 4 installed in the enclosure drain. FIG. 9, Section B-B, shows a cross sectional cut of the drain with the drain close-out valve 4 installed and closed. The drain close-out valve 4 is existing technology that is used in a revolutionary way to resolve an age long problem. The drain close-out valve 4 can be any type of valve that closes and seals the drain tube or pipe. This configuration uses an electrically controlled valve that is normally opened. The drain close-out valve 4 is closed during the cleaning cycle when the cleaner is being sprayed on the walls of the enclosure 2. The only other time that the drain close-out valve 4 is closed is if the cleaner is being returned to the dispenser immediately after the cleaning cycle.

The drain close-out valve 4 is the only functional component that is not readily available for replacement in some cases. In some case, the insert will have to be removed or the floor of the enclosure will have to be cut into to replace the drain close-out valve 4. Future models could use pneumatically controlled valves to improve maintainability or reliability. Other improvements for the maintainability of these valves will be explored and discovered.

A cross sectional view of the reservoir 5 is shown in FIG. 9 and Section B-B. Section BB also shows the run-off cleaner that pools above the closed drain close-out valve 4. Note that the cleaner pick-up tube 31 is placed well above the drain close-out valve 4. The soap scum will settle down on the drain close-out valve 4 and below this tube. In this way, the dirt and soap scum remains in the reservoir 5 and only the clean cleaner is siphoned out of the reservoir 5 and pumped 11 to the dispenser 24 for recycling. A cleanable filter is also to be considered during full development.

FIG. 10 shows an example of a control panel 6. The control panel 6 is specifically designed, programmed, and manufactured for each configuration and each embodiment as is the user interface. In this particular example, the interface includes a digital cleaning cycle time display 14, decrease cleaning cycle time button 15, increase cleaning cycle time button 16, 'Start' button 17, 'Stop' button 18, rinse cycle time display 19, increase rinse cycle time button 20, decrease rinse cycle button 21, 'Hot' button 22, and 'Cold' button 23.

The control panel 6 is powered by the household electrical supply, 110 V AC in the US, and controls the sequencing of the components based on the user input. In some configurations, the control panel 6 could be powered by a transform that is powered by the household electrical power.

The cleaning cycle time display 14 shows the length of the cleaning cycles in minutes as set by the user. The decrease cleaning cycle time button 15 and increase cleaning cycle time button 16 are used to adjust the length of the cleaning cycle in five minute increments. The 'Start' button 17 starts the cycle. The 'Stop' button 18 is used to stop the cycle should the cycle need to be interrupted. In some configurations, there is a rinse cycle available. In these configurations, the rinse cycle time display 19 will display the length of the rinse cycle as set by the user in minutes. The increase rinse cycle time button 20 and decrease rinse cycle button 21 are used to adjust the length of the rinse cycle in minutes. Depressing the 'Hot' button 22 sets the rinse cycle to use hot water where depressing the 'Cold' button 23 sets the rinse cycle to use cold water.

FIG. 5 is a schematic of the control box 1 components. In this configuration, the control panel 6, cold water rinse valve 7, cold water shut-off valve 8, hot water rinse valve 9, hot water shut-off valve 10, pump 11 (electrical or powered otherwise), check valve 12, and control box mount 13 are shown and numbered. Each of these components will be described in order.

The cold water rinse valve 7 is normally closed and opened only during a cold water rinse cycle. The cold water shut-off valve 8 is normally opened but shuts off the water to the cold water faucet any time that the drain is closed to prevent an over-flow condition. As with the cold water rinse valve 7, the hot water rinse valve 9 is normally closed. The hot water rinse valve 9 is opened only during a hot water rinse cycle. The hot water shut-off valve 10 is normally opened but shuts off the water to the hot water faucet any time that the drain is closed to prevent an over-flow condition. The pump 11 is used to pump the cleaner that pools in the reservoir 5 to the nozzles 3 under pressure to create the spray. If the option is available and selected, the pump will transfer the majority of the cleaner back into the dispenser 24 for reuse after the cleaning cycle and before the rinse cycle begins. The check valve 12 ensures that no cleaner or other contaminants inadvertently enters the household water supply.

FIG. 4, FIG. 5, and FIG. 6 show the components in the control box 1 mounted to the control box mount 13. In this case, the control box mount 13 is a simple plate that is intended to be mounted to the exterior of the wall next to the enclosure. Given the commercial demand, the control box mount 13 might be better mounted between the wall studs and behind the drywall. This would make maintenance more difficult but left to the owner's discretion for him to match his decor. The shapes, sizes, mounting methods, and materials for the control box mount 13 are flexible and determined by the installation requirements.

FIG. 10 shows one example of a dispenser 24. In this configuration, a dispenser 24 is added for the convenience of the user and to make recycling the reusable cleaner possible. The dispenser control valve 25 will open to allow the stored cleaner to run down into the reservoir 5 thus providing the initial supply of cleaner. If the cleaner recycle button 26 is depressed at the end of the cleaning cycle, the pump 11 will continue to run but the cleaner recycle valve 27 will direct the cleaner away from the nozzles 3 and back into the dispenser 24. There would also have to be a fill level indicator or warning for the dispenser 24 to notify the user when the cleaner level in the dispenser is low. That indicator could be a visual indicator or an electrical warning signal. Neither of these options are shown.

The nozzle tubing 30, cleaner supply tube 31, cold water supply line 32, hot water supply line 33, and plumbing internal to the control box 1 are typical household plumbing supplies. The wiring for the drain close-out control wire 29 as the internal wiring in the control box 1 is the typical household wiring that is approved for use in residential applications. The wire sizes are the recommended sizes per each component being operated.

With all the components for the first of four embodiments described, the operation is explained in the following paragraphs. This explanation is for the configuration that is shown in FIG. 10.

Before the cleaning device is put to use, the dispenser 24 will have at least a minimum amount of the user's preferred cleaner in it in liquid form. The user will adjust the cleaning cycle and rinse cycle times with the appropriate decrease cleaning cycle time button 14, increase cleaning cycle time button 15, increase rinse cycle time button 20, and decrease rinse cycle time button 15. To start the cleaning process after the times are set, just press the 'Start' button 17. If the times from the previous cleaning are the desired time for the current cleaning, all that is required to clean the shower is to press the 'Start' button 17.

Upon pressing the 'Start' button 17, the drain close-out valve 4, cold water shut-off valve 8, and hot water shut-off valve 10 are closed and the dispenser control valve 25 is opened. The cleaner in the dispenser 24 drains down to the reservoir 5 and pools there. Thirty seconds after the 'Start' button 17 has been pressed, the dispenser control valve 25 is closed and the pump 11 is turned on. The pump 11 supplies pressurized cleaner to the nozzles 3. The spray from the nozzles 3 continue for the length of time set by the user and shown in the cleaning cycle time display 14.

If the configuration does not include a dispenser, the user will have 30 seconds to pour the desired amount of cleaner into the enclosure before the pump starts.

At the end of the cleaning cycle, the cleaner recycle valve 27 switches and diverts the cleaner from the pump 11 to the dispenser 24 if the cleaner recycle button 26 has been depressed. After one minute of the pump 11 transferring the reusable cleaner from the reservoir 5 back into the dispenser, the pump 11 is turned off. At this time, the drain closeout valve 4 opens and dumps the lower portion of the cleaner that is suspected of having the soap scum and dirt, down the drain.

If there is no dispenser 24, the cleaning device turns off the pump 11, opens the drain close-out valve 4, and dumps all the cleaner down the drain at the end of the cleaning cycle. And if there is no rinse cycle, then this ends the cleaning and the cleaning devices turns off.

Once the drain close-out valve 4 and the cleaner has been dumped down the drain, either the cold water rinse valve 7 or the hot water rinse valve 9 is opened for the length of time shown in the rinse cycle time display 19 and set by the user. If this time is set to 0, then there is no rinse cycle. If the 'Cold' button 23 is depressed at the start of the rinse cycle, then a cold water rinse is initiated. In contrast, the 'Hot' button 22 being depressed would initiate the hot water rinse.

When the rinse cycle is complete, the cleaning is complete. Future configurations might include a second dispenser as to allow for a rinse agent to be added to the rinse water to prevent water spots. The second dispenser is not shown.

FIG. 12 shows the components that would be supplied to the homeowner or professional that will install a self-cleaning shower using the existing insert. The second of the four embodiments has the same components minus the insert. This embodiment is also intended for the custom built bathtubs and showers or those with title walls. This embodiment may or may not include the nozzles 3 and/or the dispenser 24 depending on the commercial need. Finally, the control box 1 is built to be tastefully mounted on the wall next to the enclosure 2 should the installer wish to avoid mounting the control box 1 in the wall.

The third embodiment of the four has fewer options and less automation. FIG. 13 shows an example of this embodiment. This embodiment eliminates the need to remove an existing enclosure to install the drain close-out valve 4 and connect to a water and a permanent electrical supply.

The pump 11, control panel 41, and as many as one shut-off valve 7 are located inside a specially designed control box 1. The control box 40 is designed to house these components and mount quickly and easily to the wall next to the shower or bathtub. The control panel 41 is a simplified version of the previous control panel 6 and therefore not shown in this figure. The nozzles 43 and nozzle tubing 42 are the same as the nozzles 3 and nozzle tubing 30 in the first two embodiments. If there is a rinse cycle, the water supply line 44 is to come off the shower head. To create the reservoir 5, the drain is plugged from the top with a specially designed drain plug 46. Since a shower drain is larger than a bathtub drain, there are two different size drain plugs 46. The cleaner supply tube 45 is held in place by the drain plug 46 at the drain and is routed to the supply side of the pump 11. Finally, the control panel 41 is powered by a household power cord 47 that is to be plugged in to a household outlet with a 110 V AC power supply. The final emptying of the cleaner and rinse water would be accomplished by manually pulling the drain plug 46 out of the drain.

A more elaborate configuration for this embodiment could have a dispenser 24 similar to the first two embodiments. While not in use, the user will have to manually store the drain plug 46, power cord 47, and cleaner supply tube 45.

The fourth of four embodiments is a portable cleaning device that can be used to clean a number of different enclosures. FIG. 14 shows this embodiment. This cleaning device makes no modifications to the enclosure. It easily moves from one enclosure to another and can be transported from one resident to another.

As with the third embodiment, the pump 11 and control panel 51 are located inside a specially designed control box 50. The control box 50 is designed to house the two components and be easily transported. Since the function of the cleaning device is limited, the size, options, and complexity of the control panel 51 are reduced. As with the previous embodiment, the power to the control box 50 is supplied through a household power cord 55 that is to be plugged into a household outlet with a 110 V AC power supply. This device uses the same drain plug 46 as the previous embodiment. The nozzle assembly consists of a base 52, 360° spray nozzle 53, and a telescoping support 54. The telescoping support is adjustable in height. It must be as short as the depth of a tub in the event that the tub is not enclosed by a curtain or door. It must also reach the height of the enclosure to ensure that the spray reaches the top of the enclosure 2. There is a cleaner supply tube 31 that transfers the cleaner from the drain plug 46 where the cleaner pools to the pump 11. The nozzle supply tube 56 transfers the pressurized cleaner from the pump 11 to the 360° spray nozzle 53.

A storage device on wheels makes this device easier to transport and set up. With a well-designed storage device, the cleaning device can be expanded to include a dispenser or two.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

The invention claimed is:

1. A method of cleansing a shower or bathtub or hot tub enclosure, comprising:

regulating operation of a valve between an open position and a dosed position, the valve, located beneath the bathing enclosure in communication with a drain in the shower or bathtub or hot tub enclosure;

creating a reservoir beneath the drain when the valve is in the dosed position;

regulating performance of the valve, a pump, and a liquid cleaner valve via a controller, the liquid cleaner valve configured to selectively permit a flow of liquid cleaner between a dispenser and the reservoir within the shower or bathtub or hot tub enclosure;

dispensing a liquid cleaner into water in the reservoir to form a cleaning solution;

spraying the cleaning solution through one or more nozzles onto interior surfaces of the shower or bathtub or hot tub enclosure, the one or more nozzles being located in a wall of the bathing enclosure such that the cleaning solution is sprayed onto an opposing interior surface;

collecting the cleaning solution in the reservoir with the valve in the closed position; and recycling the cleaning solution by pumping it hack through the nozzles and onto the interior surfaces using the pump, the recycling of cleaning solution through the nozzles saturates scum from the interior surfaces; and activating the pump from the controller to recycle residual liquid cleaner hack to the dispenser through the liquid cleaner valve for later use, the recycling of the liquid cleaner following a cleaning cycle.

2. The method of claim 1, wherein the one or more nozzles are aligned to disperse cleaning solution over each interior surface.

3. The method of claim 1, wherein the one or more nozzles are embedded into one or more bathing features.

4. The method of claim 1, wherein the one or more nozzles are configured to oscillate.

5. The method of claim 1, wherein the valve is in the closed position only during cleaning of the shower or bathtub or hot tub enclosure.

6. The method of claim 1, wherein the cleaning solution is continuously recycled through the one or more nozzles during the cleaning cycle.

7. The method of claim 1, wherein the pump is an electrical pump.

8. The method of claim 1, wherein the controller provides a user interface to regulate a cleaning cycle, wherein the cleaning solution is sprayed through the one or more nozzles.

9. The method of claim 8, wherein the controller displays a digital cleaning cycle time on a display.

10. The method of claim 8, wherein the user may adjust the time of a cleaning cycle.

11. The method of claim 8, wherein the user may turn on and off a cleaning cycle.

12. The method of claim 8, wherein the user may regulate the temperature of the water mixed with the liquid cleaner.

13. The method of claim 1, further comprising:

opening the valve and disposing of the recycled cleaning solution through the drain and the valve.

* * * * *